US008344276B2

(12) United States Patent
Freyermuth

(10) Patent No.: US 8,344,276 B2
(45) Date of Patent: Jan. 1, 2013

(54) CONTACT ARRANGEMENT FOR WEAK CURRENT APPLICATIONS

(75) Inventor: Thomas Freyermuth, Kalenborn (DE)

(73) Assignee: Eaton Industries GmbH, Bonn (DE)

( * ) Notice: Subject to any disclaimer, the term of this patent is extended or adjusted under 35 U.S.C. 154(b) by 294 days.

(21) Appl. No.: 12/761,188

(22) Filed: Apr. 15, 2010

(65) Prior Publication Data

US 2010/0294634 A1 Nov. 25, 2010

(30) Foreign Application Priority Data

Apr. 18, 2009 (DE) ..... 10 2009 018 035

(51) Int. Cl.
*H01H 1/36* (2006.01)

(52) U.S. Cl. ..... 200/252

(58) Field of Classification Search ..... 200/252, 200/262, 263, 265, 266; 428/544, 545; 439/188
See application file for complete search history.

(56) References Cited

U.S. PATENT DOCUMENTS

| | | | | |
|---|---|---|---|---|
| 1,785,618 | A * | 12/1930 | Salisbury | 200/263 |
| 2,519,872 | A * | 8/1950 | Bellows, Jr. | 200/263 |
| 5,705,297 | A * | 1/1998 | Warren | 429/244 |
| 6,246,020 | B1 * | 6/2001 | Sato | 200/263 |
| 6,787,722 | B2 * | 9/2004 | Tsutsui | 200/512 |
| 2006/0096846 | A1 * | 5/2006 | Rival et al. | 200/400 |

FOREIGN PATENT DOCUMENTS

| | | | |
|---|---|---|---|
| DE | 844197 | C | 7/1952 |
| DE | 1049472 | B | 1/1959 |
| DE | 242767 | B1 | 10/1989 |
| DE | 202005015319 | U1 | 2/2006 |
| DE | 2010-029341 | A1 * | 12/2009 |
| GB | 933239 | A | 8/1963 |

* cited by examiner

*Primary Examiner* — Edwin A. Leon
(74) *Attorney, Agent, or Firm* — Leydig, Voit & Mayer, Ltd.

(57) ABSTRACT

An electrical contact arrangement for weak current applications includes at least one fixed contact including a first contact material, a moving contact configured to be brought into a closing and an opening position with the at least one fixed contact, and a contact bridge which carries the moving contact and includes at least one contact piece including a second contact material. The contact bridge is configured to be actuated in a longitudinally movable manner toward the fixed contact. The first contact material is a metallic conducting material and the second contact material includes at least 70% carbon material.

17 Claims, 2 Drawing Sheets

CONTACT ARRANGEMENT FOR WEAK CURRENT APPLICATIONS

CROSS-REFERENCE TO RELATED APPLICATIONS

This application claims the benefit of priority under 35 U.S.C. 119 (b) to a German Application No. 10 2009 018 035.4 filed Apr. 18, 2009.

FIELD

The invention relates to a contact arrangement for weak current applications.

BACKGROUND

Specific contact arrangements require weak current applications, in particular in electrical appliances or electric circuits which are designed with electronic controllers. Auxiliary or signal switch contacts in applications of this type switch only very low currents (<1 A), at low control voltages, for example up to 60 V. For low currents, for example less than 100 mA, materials having low inherent resistance (gold, silver, copper) are preferably used; not least also due to the formation of oxides in less noble metals.

Metallic abrasion of the contacts leads to the drawback that fine-grained particles readily oxidise and impair the contacting. Alternatively, the contact material itself forms a non-conductive oxide. Bridge contacts are provided with spray oil mist in order to prevent or reduce oxide formation, accumulation of dirt on the contact faces and to reduce wear to the contact faces. The use of contact arrangements of this type, which derive from previously used standard contacts, are therefore no longer appropriate for various reasons.

SUMMARY

In an embodiment, the present invention provides an electrical contact arrangement for weak current applications. The electrical contact arrangement includes at least one fixed contact including a first contact material, a moving contact configured to be brought into a closing and an opening position with the at least one fixed contact, and a contact bridge which carries the moving contact and includes at least one contact piece including a second contact material. The contact bridge is configured to be actuated in a longitudinally movable manner toward the fixed contact. The first contact material is a metallic conducting material and the second contact material includes at least 70% carbon material.

BRIEF DESCRIPTION OF THE DRAWINGS

Further details and advantages of the invention will be described using a plurality of exemplary embodiments and with reference to the figures, in which specifically.

DETAILED DESCRIPTION

Figure 1A:
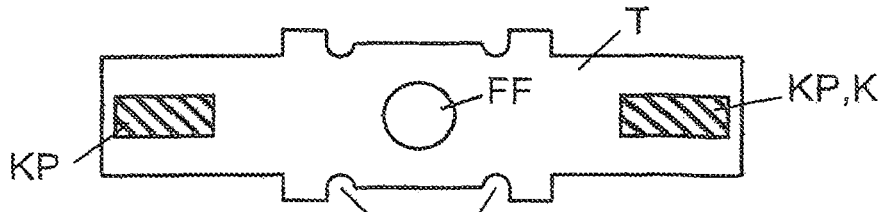
FIGS. 1A to 1D show four contact bridges in a view from the direction of the fixed contacts.

Embodiments of the invention present a further development of contact arrangements for weak current applications.

An embodiment of the invention is achieved by the features of the independent claim, while the dependent claims disclose additional advantageous embodiments of the invention.

One embodiment of the invention employs an electrical contact arrangement that comprises: at least one fixed contact made of a first contact material, a moving contact which can be brought with the at least one fixed contact into a closing and opening position, a contact bridge which carries the moving contact and has at least one contact piece made of a second contact material, wherein the contact bridge can be movably actuated toward the fixed contact in a longitudinally movable manner, and wherein a material pairing of the contact-making elements is provided in such a way that a first contact material is made of a metallic conducting material, preferably of a copper or silver alloy, and a second contact material has a composition consisting of at least 70% carbon material. All references hereinafter to graphite refer generally to one of the carbon materials used. Preferably, isostatically pressed graphite (also known as iso-graphite) is in particular proposed for the contact piece.

The contact arrangement is principally a pick-up or bridge contact, comprising a contact bridge made either of sheet metal or of insulating material.

Although contacts made of carbon material have increased internal resistance (compared to metallic contacts), the proposed contact arrangements have technical and economic advantages in signal and auxiliary switch contacts having control currents of <1 A and control voltages of up to <60V. For example, carbon does not form any oxides at its surface, and if it does, only volatile $CO_2$ is produced.

Tests have shown that solid contacts made of carbon material do not break in the circuitry of signal currents (24 V, max. 1A). Solid contacts made of carbon material have low mass (and as a result also low bounce behaviour, and are thus ready sooner for signal transmission). Spray oil mists are not necessary, as the contact resistance does not increase during operation. The contacts are more economical, as no noble metal or copper is used. Contacts made of carbon material are lighter than metal contacts. The moving contact therefore has a lower mass that has to be moved and braked by the drive. Carbon material as abraded material can lubricate the contact-making parts. Because the abraded material remains conductive and does not oxidise, it does not reduce the contacting. Graphite also prevents welding or adhesive bonding of the contacts. Mechanical guides and sliding faces in the contact equipment are additionally lubricated by graphite abraded material and the sliding properties are not impaired as in metal abrasion.

In an embodiment, one contact point comprises a conventional AgNi contact. The other contact point is provided with carbon material. The AgNi contact is provided with a ribbing and is soldered onto, welded or riveted to the contact carrier (fixed contact or contact bridge). The contact made of carbon material comprises a round rod or a platelet the size of the AgNi contact, which is adhesively bonded to the contact carrier (fixed contact or contact bridge) using graphite adhesive. In one embodiment, the platelet includes a ribbing. The rod or the ribbing has an orientation rotated through 90° in relation to the mating contact.

Further embodiments are set out hereinafter:

A second contact material is comprised 70% or more of carbon material and a remainder of metal powder. A composition of this type is also referred to as metal graphite or metal-impregnated, for the production of which mixtures of metal powders, in particular copper, tin or lead, with graphite, in particular natural graphite, are compressed and subsequently compacted by annealing or sintering. A second contact material is comprised entirely (100%) of carbon material.

Preferably, the contact material of the moving contact(s) is made of carbon material.

At least one of the contact pieces (on the fixed contact or on the moving contact) is provided with a ribbing. Ribbings with grooves are also be present on the associated contact-making elements, preferably in such a way that the grooves on one contact piece are arranged perpendicularly to the grooves on the other contact piece.

The contact arrangement preferably has two fixed contacts, wherein just a single contact piece or else a plurality of contact pieces can be associated with the fixed contacts. The contact pieces are fastened to the contact bridge, wherein use may be made of adhesive connections or mechanical mounts. In an embodiment, the material of the contact bridge is metallic, e.g., designed so as to be conductive or insulating. In the case of an insulating property of the contact bridge, use is made of a single contact piece which lies with its full length on the contact bridge and bridges the fixed contacts in the closed state of the contact arrangement. In the case of a metallic contact bridge, use may be made of smaller contact pieces which are associated with the respective fixed contacts. The size of the contact pieces corresponds to the area of the respective fixed contacts.

The contact piece or pieces may be designed as a round rod or as a cuboidal platelet. The round rods may be designed as a full cylinder or as a half cylinder. In the case of a half cylinder, the flat side of the half cylinder is used as an adhesive face.

The contact piece is fastened to the contact bridge using at least one clamp.

Contact pieces, in particular those in the form of round rods, are mounted in brackets on or in the contact bridge.

The features of the invention may be designed individually or jointly in various embodiments.

FIGS. 1A through 6 each show views of moving contacts K designed in the form of contact bridges T. In addition, some of the figures show side views from the front or from the side. The figures are preferably intended to show that (two) stationary contacts are bridged by a movable contact under the pressure of a spring means or are held open by a restoring element (contact ram). The stationary contacts are not shown in the drawings. Restoring elements (for example springs), which bring the moving contacts into the position of contact with the fixed contacts, are not shown either. The contact arrangement can be actuated by a contact ram, wherein the actuation of the contact can be carried out counter to the restoring force of a restoring element or counter to the press-on force of a spring means. The movable contact consists of a contact bridge carrying at least one contact piece associated with the stationary contacts. The contact bridge comprises a contact plate.

The fixed contact or contacts or contact pieces K on the contact bridge T are associated with the respective fixed contacts. The contact pieces made of carbon material are shown grayed out.

Figure 1B:
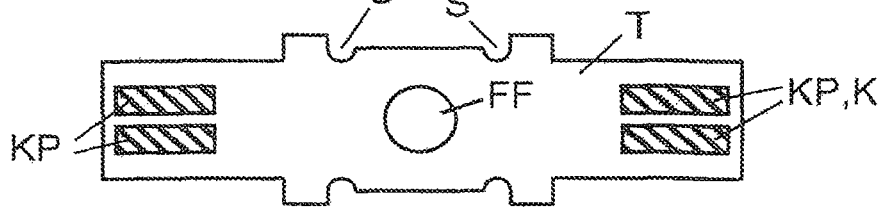
Figure 1C:
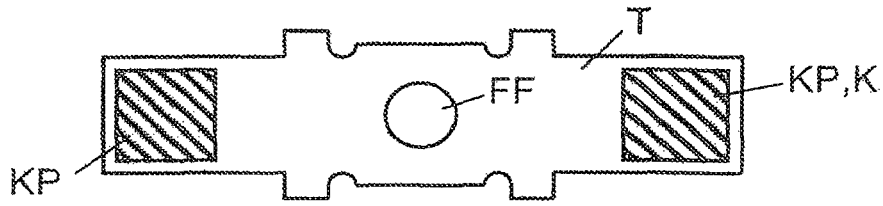

FIGS. 1A to 1D show four contact bridges T in a view from the direction of the fixed contacts. The contact pieces KP of the contact bridges T of FIGS. 1A to 1C are designed in a platelet-like manner. The contact pieces KP are made of carbon material and adhesively bonded to a metallic contact bridge by means of graphite adhesive. The contact pieces KP are arranged in such a way as to each be associated with the fixed contacts. Reference symbol FF denotes in each case guides which are intended to serve to mount and/or to fasten contact press-on springs or actuating rams. The outlines of the contact bridges T are also formed by punchings S in such a way as to produce working faces or working points for guides, mounts and/or fastenings. It should also be mentioned that there are embodiments in which the contact pieces are designed as a half or full cylinder, and these contact pieces can be arranged where planar contact pieces are shown in FIGS. 1A to 1C. As shown in FIG. 1B for planar contact pieces, two round rods can also be attached next to each other to one contact point each.

Figure 1D:
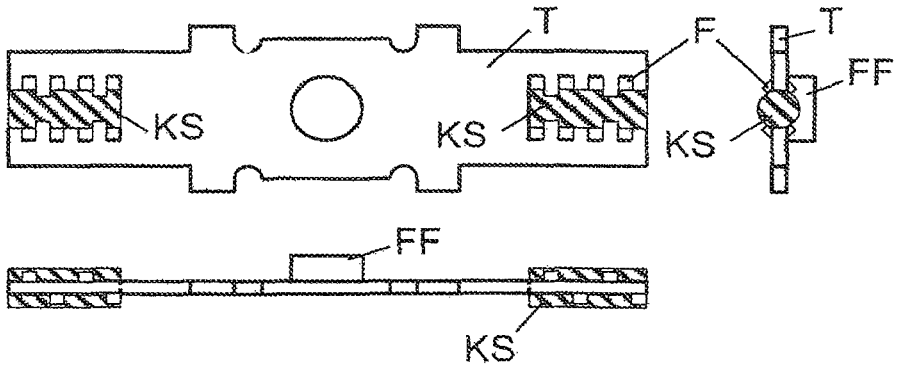

In FIG. 1D round rods KS made of carbon material are each inserted into two brackets F arranged on the end side. In an embodiment, the brackets are designed in a manner known from gold work.

Figure 2:
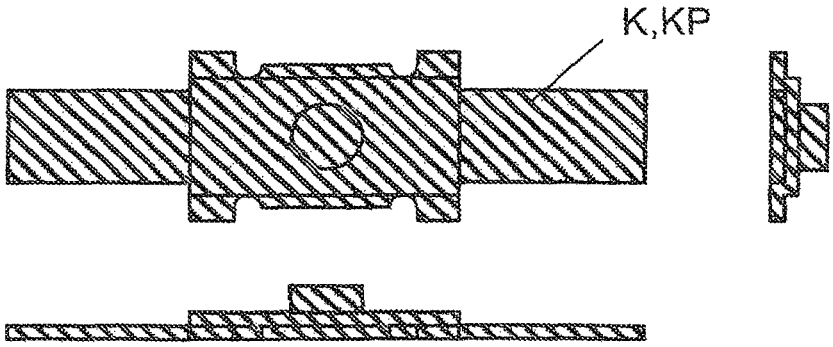
FIG. 2 shows a contact bridge made entirely of carbon material.

FIG. 2 shows a contact bridge made completely—e.g., including the carrier shape and the edge formation—of cuboidal carbon material. The entire bridge contact and thus the carrier material of the bridge and the contacts are replaced by a single body made of carbon material in the length of the bridge. A process of fastening or adhesively bonding the contact material to the contact bridge is thus dispensed with. The body made of carbon material can also be designed so as to be—unlike in FIG. 2—round: cf. FIG. 5.

Figure 3:
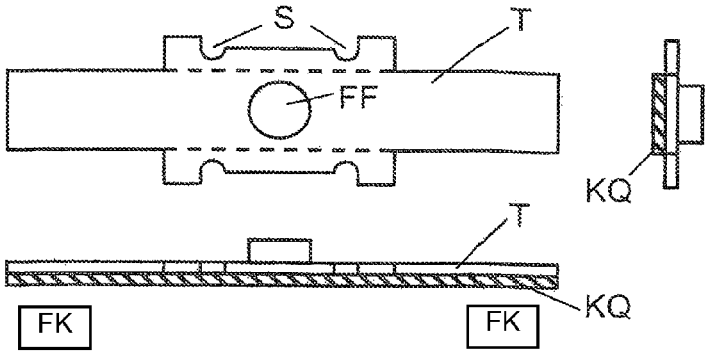
FIG. 3 shows a contact bridge with a single contact piece as a cuboidal platelet.

FIG. 3 shows a contact bridge in which a platelet KQ made of carbon material is attached over the full length (directed toward the fixed contacts). There is sealing material consisting of a plurality of thin layers of pure graphite that are provided layer-by-layer with an adhesive layer. The platelet KQ can also be made of this material and adhesively bonded to the contact bridge T.

Figure 4:
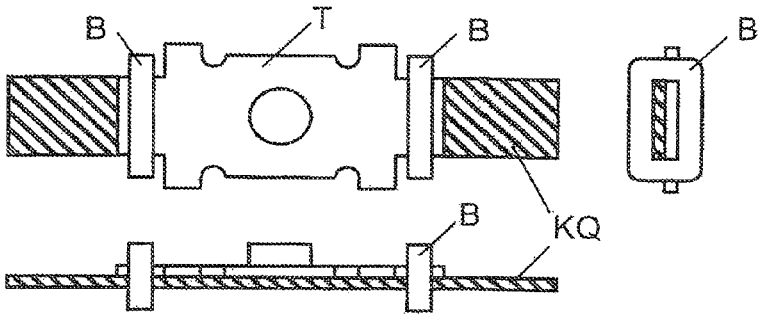
FIG. 4 shows a contact bridge with a single contact piece mounted using fastening clamps.

FIG. 4 shows a type of fastening for a platelet KQ made of carbon material that is distinguished by the use of two fastening clamps B.

Figure 5:
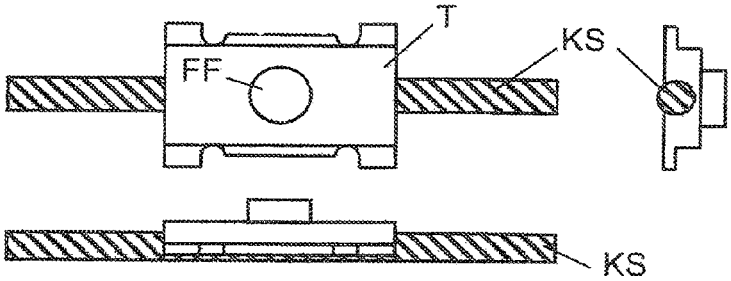
FIG. 5 shows a contact bridge with a contact piece as a round rod.

FIG. 5 presents an embodiment of a contact bridge in which a round rod KS made of carbon material is carried by the contact bridge—with an additional plastics material part as the holder. The contact bridge T juts out beyond the holder on both sides. In this case, adhesive connections and transition resistances associated therewith are then dispensed with altogether.

The drawings do not show an arrangement in which two round rods are provided parallel to each other, which are for example inserted into brackets or adhesively bonded to the contact bridge.

Figure 6:
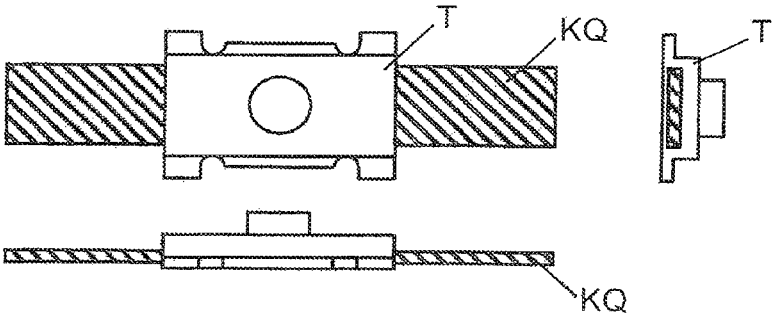
FIG. 6 shows a contact bridge with a platelet-like contact piece mounted in the contact bridge.

In FIG. 6—in a manner comparable to FIG. 3—a cuboidal platelet KQ made of carbon material is accommodated in the contact bridge T. The platelet KQ juts out beyond the contact bridge T on both sides. Dotted lines indicate that the platelet can have different widths. A part of this type—as shown in FIG. 6—can for example be produced in such a way that the platelet KQ is carried by a plastics material part formed by sheathing the contact bridge T.

LIST OF REFERENCE SYMBOLS

T contact bridge or contact plate
K contact piece contact material
KS round rod shape of the contact piece
KP platelet shape of the contact piece
KQ cuboidal shape of the contact piece
S punchings in the contact plate F bracket for round rod
B fastening clamp
FF mount or guide for contact press-on spring or contact ram All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An electrical contact arrangement for weak current applications for switch contacts, comprising:

at least one fixed contact including a first contact material;

a moving contact configured to be brought into a closing, and an opening position with the at least one fixed contact; and a graphite contact bridge which carries the moving contact and includes at least one contact piece including a second contact material, wherein the contact bridge is configured to be actuated in a longitudinally movable manner toward the fixed contact, and further configured to electrically connect the fixed contact to another fixed contact via the contact bridge;

wherein the first contact material is a metallic conducting material and the second contact material includes at least 70% carbon material.

2. The contact arrangement according to claim 1, wherein the second contact material includes 100% carbon material.

3. The contact arrangement according to claim 1, wherein the carbon material is an isostatically pressed graphite material.

4. The contact arrangement according to claim 1, wherein the carbon material is multilayered with intermediate adhesive layers.

5. The contact arrangement according claim 1, wherein a contact material of the moving contact includes carbon material.

6. The contact arrangement according to claim 1, wherein the at least one contact piece includes a ribbing.

7. The contact arrangement according to claim 1, wherein the at least one fixed contact includes two fixed contacts and the at least one contact piece includes a single contact piece disposed on the contact bridge.

8. The contact arrangement according to claim 7, wherein the at least one contact piece includes a round rod.

9. The contact arrangement according to claim 7, wherein the at least one contact piece includes a cuboidal platelet made of carbon material.

10. The contact arrangement according to claim 8, wherein the at least one contact piece is fastened to the contact bridge by at least one clamp.

11. The contact arrangement according to claim 10, wherein the clamp includes a sheathing of the contact bridge with a plastic material.

12. The contact arrangement according to claim 1, wherein the at least one fixed contact includes two fixed contacts and the at least one contact piece includes two contact pieces made of carbon material respectively associated with the fixed contacts disposed on the contact bridge.

13. The contact arrangement according to claim 12, wherein the contact pieces include platelets.

14. The contact arrangement according to claim 12, wherein the contact pieces include round rods.

15. The contact arrangement according to claim 1, wherein the at least one contact piece is adhesively bonded to the contact bridge.

16. The contact arrangement according to claim 1, wherein the at least one contact piece is disposed in brackets on or in the contact bridge.

17. The contact arrangement according to claim 1, wherein the metallic conducting material is at least one of a copper alloy and a silver alloy.

* * * * *